United States Patent [19]

Zielinski et al.

[11] Patent Number: 4,934,959

[45] Date of Patent: Jun. 19, 1990

[54] ENVIRONMENTALLY SEALED CONNECTOR, HOUSING THEREFOR

[75] Inventors: Thomas E. Zielinski, St. Clair; Paul W. Geyer, Rochester, both of Mich.

[73] Assignee: Chrysler Corporation, Highland Park, Mich.

[21] Appl. No.: 383,699

[22] Filed: Jul. 24, 1989

[51] Int. Cl.[5] ..... H01R 13/44

[52] U.S. Cl. ..... 439/595; 439/598

[58] Field of Search ..... 439/594, 595, 598, 603

[56] References Cited

U.S. PATENT DOCUMENTS

| | | | |
|---|---|---|---|
| 3,686,619 | 8/1972 | McCardell Jr. et al. | 439/595 |
| 4,557,542 | 12/1985 | Coller et al. | 439/595 |
| 4,565,416 | 1/1986 | Ruby et al. | 439/595 |
| 4,820,198 | 4/1989 | Lulko et al. | 439/595 |

*Primary Examiner*—P. Austin Bradley

*Attorney, Agent, or Firm*—Wendell K. Fredericks

[57] ABSTRACT

Plug and socket housings of in-line cable assemblies providing terminal receiving channels disposed so that different size terminals are placed on a common horizontal center line. The housings permit two tiers of terminals to be housed.

5 Claims, 2 Drawing Sheets

ENVIRONMENTALLY SEALED CONNECTOR, HOUSING THEREFOR

BACKGROUND OF THE INVENTION

1. Field of the Invention

This invention relates to plug and socket housing of cable assemblies and more particularly in a preferred embodiment to housings for environmentally sealed cable assemblies.

2. Description of the Prior Art

In prior art cable assemblies where the sockets and plugs carry several different sizes of terminals, a problem exists in forming housings, arranging primary locking fingers in terminal receiving channels, locking the locking fingers in the annular recess areas of the terminals with pads disposed on a secondary locking bar. In forming a housing for holding large and small diameter terminals, a problem exists when molding such a housing. In housings where terminal receiving channels for small pins are disposed adjacent to one another, the molding material cools and shrinks evenly. But when a receiving channel for large diameter terminals is placed adjacent to a receiving channel for small terminals, the material between these two terminals do not cool and shrink at the same rate as the material between two small receiving channels. Hence, during the molding process, steps are taken to cause the walls between the large receiving channel and a small receiving channel to cool and shrink at the same rate that the walls between the small receiving terminals cool and shrink. To remedy this problem, the wall's thickness between a large and a small receiving channel is reduced to provide a thickness comparable to the thickness between a pair of small receiving channels. A slot or "lighter" is formed to reduce the wall thickness. This slot prevents the material from collapsing between the terminals due to the fact that it cools slower than the materials between two small channels.

Another problem that exists in the prior art concerns the primary locking fingers. The locking fingers are formed from resilient material and arranged in the housing during the molding process. The fingers are used to lock the terminals in the housing by engaging an annular recess of the terminals. Since the diameter of the small terminals and the large terminals are different, the prior art housings provided space for mounting the large terminals on different horizontal center lines from the center lines provided for small terminals. Because of this, the locking fingers for the large and small terminals have different heights.

To compensate for the different heights of the locking fingers of the prior art, the secondary locking bar carried pads of different heights for the large and small terminals. An approach that forms different size pads on the locking bar was needed during the process of forming locking bars.

In an effort to minimize the problem of molding different size pads for the locking bars and forming different horizontal center lines for the large and small terminals, and to eliminate the need for providing "lighters", a search for various other housing structures was initiated. This search resulted in the improved cable assembly housing of the present invention.

SUMMARY OF THE INVENTION

The present invention concerns cable assembly housings for environmentally sealed cable assemblies. In a preferred embodiment, elongated squares rather than circular terminal receiving channels are formed in the housing in a manner that permits a common horizontal center line through large and small terminals. Also, all walls between terminal receiving channels are of like thickness, hence eliminating the need for "lighters". Pads of even height are disposed on the locking bar which permit effective environment sealing. A pair of handles is provided on each locking bar for easy disassembly of the socket and plug if desired.

DESCRIPTION OF A PREFERRED EMBODIMENT

Figure 1:
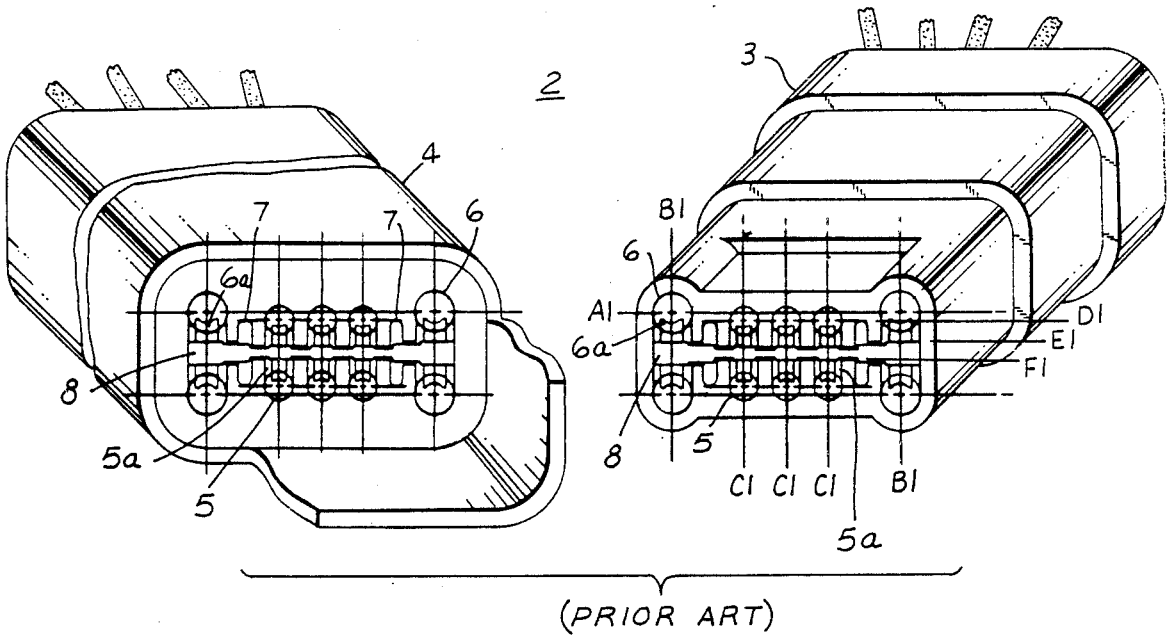
FIG. 1 is a perspective view of a plug and socket of a prior art, in-line cable assembly illustrative of circular terminal receiving channels.

Referring to FIG. 1, there is shown a plug housing 4 and a socket housing 3 for an in-line prior art cable assembly 2. These housings are shown without terminals in order to illustrate the terminal arrangements.

Plug housing 4 is molded so as to house a double tier of mixed sized terminals, small male terminals and large male terminals. Note that the receiving channels for the large and small terminals 6 and 5, respectively, are on different center lines, A1 and D1 respectively.

Also note that the spacing between the vertical center lines B1 and C1 of the adjacent large and small receiving channels is different from the spacing between the small receiving channels. Also "lighter" regions (LTH) 7 are provided between the adjacent large and small receiving channels in order to promote even drying of the wall material during the molding process.

Note that the secondary locking bar (LB) 8 carries pads such that the large terminal locking fingers **6*a* are locked in place at the interface (E1) and the small terminals are locked in place with locking fingers 5*a* at the interface (F1**).

Figure 2:
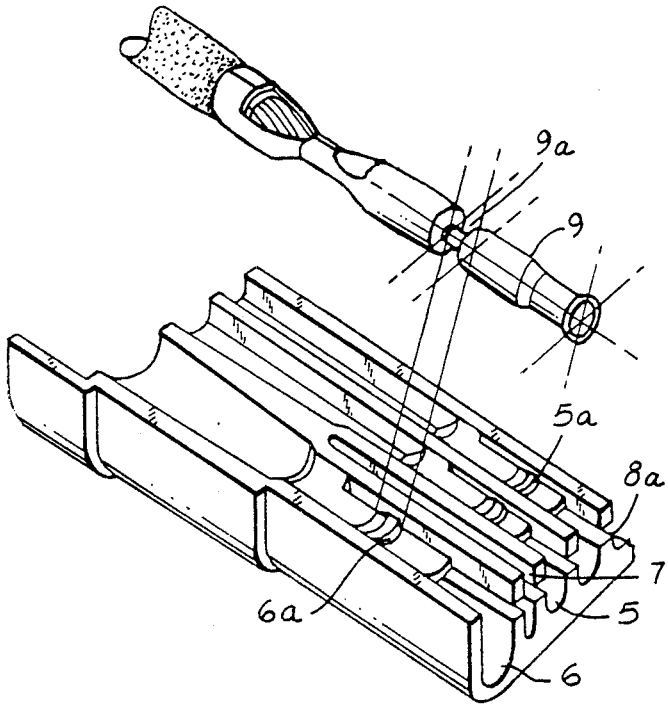
(PRIOR ART) FIG. 2
FIG. 2 is a partial cut-away view of a socket in FIG. 1 illustrative of the locking finger interaction with the annular recess of a terminal and of the region in which a "lighter" is needed.

With reference now to FIG. 2, a cut-away view of the prior art socket which shows a view of the "lighter" 7 used for reducing the thickness of the walls between the large terminal receiving channels 6 and small terminal receiving channels 5. Also note that the locking fingers **6*a* for the large terminal are off-set from the locking finger 5*a* for the small terminals. A cavity 8*a* for the locking bar 8 of FIG. 1** is shown extending through the small and large receiving channels as well as the "lighter".

Also, a large female terminal 9 of FIG. 2 is illustrated to show how an annular recess **9*a* of the terminal interacts with large locking finger 6*a***.

Figure 3A:
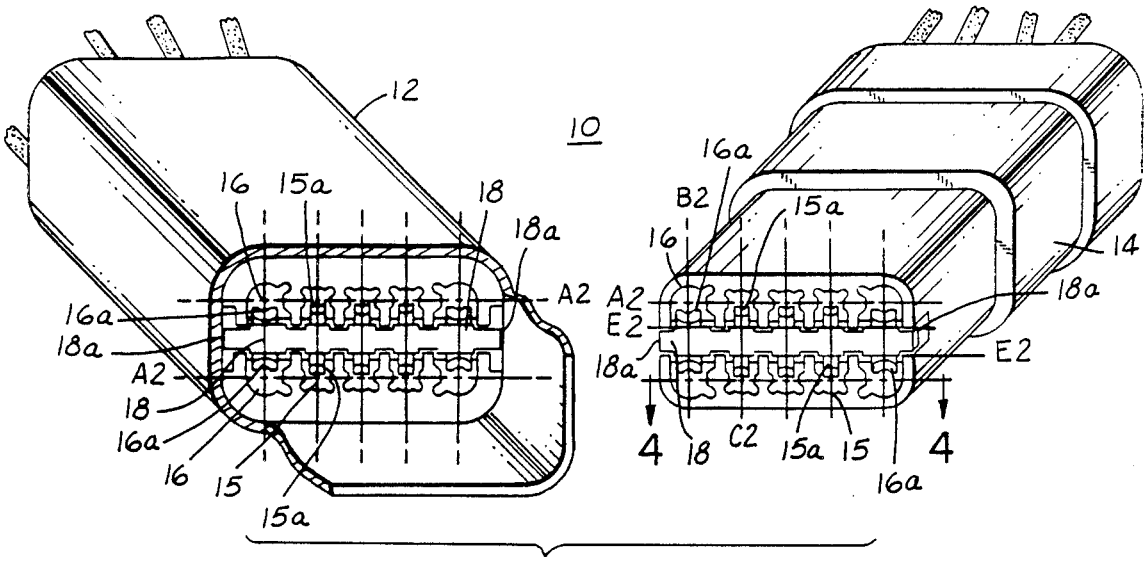
FIG. 3A is a perspective view of a plug and socket of an in-line cable assembly illustrative of a square terminal receiving channel and constructed in accordance with the present invention.
Figure 3B:
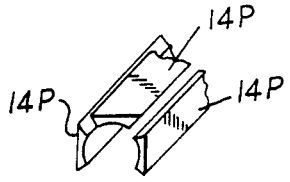
FIG. 3B is a perspective view of a set of alignment pads that are disposed in the square receiving channels.

With reference now to FIG. 3*a*, there is shown a plug housing 12 and socket housing 14 of an in-line cable assembly 10 of the present invention. In this embodiment, the large and small terminal receiving channels 16 and 15, respectively, are essentially square in shape rather than circular. In order to maintain stability of the terminal in the channels, alignment pads 14P are disposed as shown in FIG. 3B and are fixedly mounted to three sides of the square channel walls for holding the periphery of the terminals in alignment with the channels. Note that the horizontal center line for both the large and small receiving channels A2 of FIG. 3A are in line. Also, the spacing between the vertical center lines for the large and small channels (B2) and (C2), respectively, are closer together than the comparable center lines in the prior art assembly shown in FIG. 1. Also, the large and small locking fingers **16*a* and 15*a*, respectively, interface with the pads of the lock bar 18 along a single interface line (E2). Since no "lighters" are used, handles 18*a* are provided at the edges of the lock bar 18 to provide a means for removal of lock bar 18** during disassembly of the terminal assembly.

Figure 4:
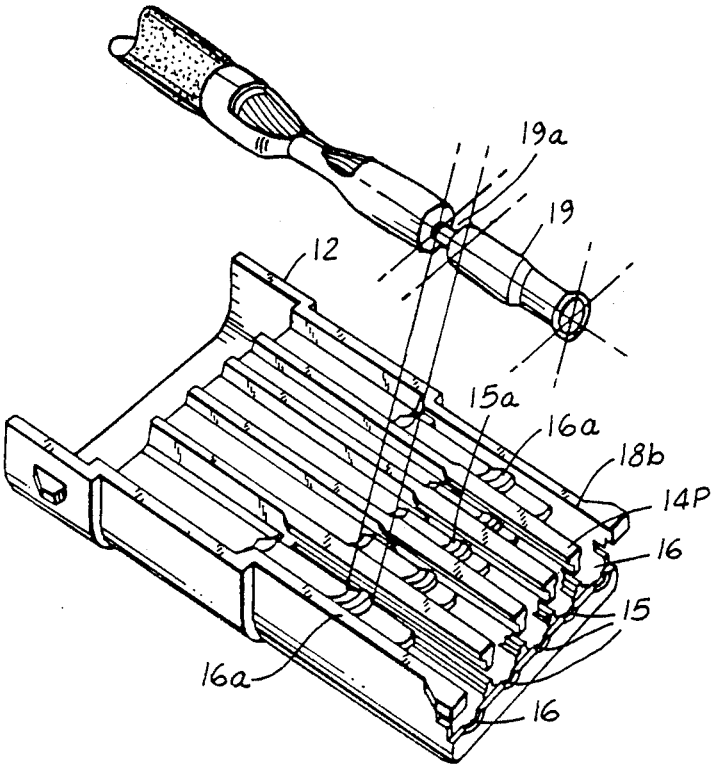
FIG. 4 is a partial cut-away view of a socket of FIG. 3 illustrative of the locking finger interaction with the annular recess of a terminal and the absence of "lighters".

With reference now to FIG. 4, note that the walls between the receiving channels are substantially the same thickness. Also the alignment pads 14P are shown extending the length of the receiving channels.

A female terminal 19 is disposed to show how a nib of the locking finger **16*a* engages an annular recess 19*a*** of the terminal.

The terminals are held in alignment in these square shaped channels 15 and 16 by alignment pad 14P. The terminals are secondarily locked in place by the lock bar 18 which is received in a centrally located cavity **18*b*** that extends between E2 and E2 of FIG. 3*a*.

Refer now to Table I which shows data that illustrates further advantages of the housing arrangement of the present invention.

TABLE I

| | Prior Art System | Present System |
|---|---|---|
| Vertical Centerline Spacing | C1–C1 | C2–C2 |
| | 3.96 mm | 4.30 mm |
| | B1–C1 | B2–C2 |
| | 5.72 mm | 5.20 mm |
| Horizontal Centerline Spacing | A1–A1 | A2–A2 |
| | 7.62 mm | 7.70 mm |
| | D1–D1 | |
| | 6.30 mm | |
| Height | 20.52 mm | 18.50 mm |
| Width | 32.26 mm | 29.50 mm |

Note that by using centerlines A2–A2 and C2–C2 in the present invention, the horizontal and vertical terminal spacing is increased but no additional centerlines such as D1–D1, and F1 in the prior art is needed. Also note that the overall size of the present housings is smaller in height and width when compared with the prior art housings for comparable pins.

The terminal receiving channel arrangement of the present invention also makes for effectively disposing the cavity **18*b* between the double tier of pin terminals for receiving the secondary locking bar that can be inserted and removed from the environmentally sealed in-line plug and receptacle using handles 18*a***.

I claim:

1. A pair of molded housings of an in-line plug and socket connector assembly for housing female terminals in the socket and male terminals in the plug;

wherein each of the male and female terminals has an annular recess at a chosen position along a front shaft of the terminal for use in locking the terminal into the housing;

wherein a diameter of a chosen number of male and female terminals differ from the diameter of the remainder of the plurality of male and female terminals;

wherein each of the male and female terminals includes a pair of crimping arms at a rear end for crimping a wire to the terminal;

wherein several mechanical locking means are used to lock the terminals in the housings;

wherein the plug housing is comprised of two molded sections, a front undivided cavity for receiving the socket and a rear cavity for receiving the plurality of plug terminals;

wherein the socket housing is a single molded section for housing the plurality of socket terminals; said pair of housings comprising:

(a) a first elongated locking bar receiving cavity disposed at a central region of the rear section of the plug housing and extending the length of the rear section for the elongated terminal receiving channels extending substantially the length of the housing for receiving a secondary locking bar, the locking bar being one of the several mechanical locking means for locking the terminals in the plug housing;

(b) another elongated locking bar receiving cavity disposed at a central region of the single section of the socket housing and extending substantially the length of the housing for receiving another secondary locking bar, the other locking bar being another of the several mechanical locking means for locking the terminals in the socket housing;

(c) a plurality of substantially square arch-shaped, three-sided terminal receiving channels extending the length of the rear section of the plug housing and the length of the single section of the socket housing above and below said first and said other lock bar receiving cavities of the plug and socket housings respectively, a horizontal center line of the plug and socket housing extending through a central axis of each terminal receiving channel, a bottom of each of said channels having an opening that extends into an associated one of said first or said other lock bar receiving cavities, each of said receiving channels having a first and a second chamber, said first chamber being used for enclosing a resilient locking finger containing a nib at one end and pivots from a pivot point on a front wall of the second chamber, said nib on each of said locking fingers extending through the opening in the bottom of each of said chambers disposed above said lock bar receiving cavity and in the top of said chambers disposed above said lock bar receiving cavity for engaging the annular recess on the front shaft of a terminal inserted in each of said channels, said second chamber having four side walls for housing the pair of crimping arms of the terminal used to connect a wire and covering insulation to the terminal; and (d) a terminal alignment pad disposed on each wall of said plurality of substantially square, arch-shaped, three-sided terminal receiving channels within said first chamber for holding the terminal inserted in each of said channels spaced equally apart from each wall of each first chambers and for holding the annúlar recess of each terminal fixedly against the nib of said resilient locking finger engaging the annular recess.

2. Said housings of claim 1 wherein a face of each of said alignment pads has a concave-shape conforming substantially to the shape of the front shaft of each of the terminals.

3. Said housings of claim 2 wherein said resilient finger and said alignment pads are integrally molded in the plug and socket housings.

4. Said housings of claim 3 wherein said plurality of terminal receiving channels include a first group of said channels having a diameter different from the diameter of a second group of said channels, said first and said group of channels.

5. Said housings of claim 4 having a horizontal center line of the plug and socket housing extending through a central axis of each of said plurality of terminal receiving channels of said first and said second group of said channels.

* * * * *

UNITED STATES PATENT AND TRADEMARK OFFICE

CERTIFICATE OF CORRECTION

PATENT NO. : 4,934,959

DATED : June 19, 1990

INVENTOR(S) : Thomas E. Zielinski, et al.

It is certified that error appears in the above-identified patent and that said Letters Patent is hereby corrected as shown below:

Column 1, line 35, change "lighter" to read --"lightener"--;
line 38, change "materials" to read --material--;
line 61, change "lighters" to read --lighteners--.

Column 2, line 6, and line 30-31 change "lighters" to read --lighteners--;
line 8; change "environment" to read --environmental--;
line 19, 47, 57, and 65, change "lighter" to read --lighteners--;

Column 3, line 19, change "lighers" to read --lighteners--;
line 33, after "18", insert --of Fig. 3A--;
line 33, after "18b", insert --of Fig. 4--;
line 55, after "F1", insert --of Fig. 1--;
line 61, after "18b", insert --of Fig. 4--;
line 64, after "18a", insert --of Fig. 3A--.

UNITED STATES PATENT AND TRADEMARK OFFICE

CERTIFICATE OF CORRECTION

PATENT NO. : 4,934,959

DATED : June 19, 1990

INVENTOR(S) : Thomas E. Zielinski, et al

It is certified that error appears in the above-identified patent and that said Letters Patent is hereby corrected as shown below:

Column 4, lines 24-26, delete "for the elongated terminal receiving channels extending substantially the length of the housing".

Column 5, lines 4 and 5, correct "first chambers" to read --first chamber--.

Signed and Sealed this

Nineteenth Day of November, 1991

*Attest:*

*Attesting Officer*

HARRY F. MANBECK, JR.

*Commissioner of Patents and Trademarks*